US009469497B2

(12) United States Patent
Nakano

(10) Patent No.: US 9,469,497 B2
(45) Date of Patent: Oct. 18, 2016

(54) DRIVE APPARATUS, SHEET TRANSPORT APPARATUS AND SHEET COLLECTION APPARATUS

(71) Applicant: Takahiro Nakano, Yamanashi-ken (JP)

(72) Inventor: Takahiro Nakano, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/581,376

(22) Filed: Dec. 23, 2014

(65) Prior Publication Data

US 2015/0307301 A1 Oct. 29, 2015

(30) Foreign Application Priority Data

Apr. 28, 2014 (JP) ..... 2014-092614

(51) Int. Cl.

| | |
|---|---|
| ***B65H 31/34*** | (2006.01) |
| ***B65H 7/20*** | (2006.01) |
| ***B65H 5/00*** | (2006.01) |
| ***B65H 7/08*** | (2006.01) |
| ***H01F 7/122*** | (2006.01) |
| ***B65H 29/04*** | (2006.01) |
| ***B65H 31/10*** | (2006.01) |
| ***B65H 33/08*** | (2006.01) |

(52) U.S. Cl.

CPC ..... *B65H 31/34* (2013.01); *B65H 5/00* (2013.01); *B65H 7/08* (2013.01); *B65H 7/20* (2013.01); *B65H 29/041* (2013.01); *B65H 31/10* (2013.01); *B65H 33/08* (2013.01); *H01F 7/122* (2013.01); *B65H 2220/01* (2013.01); *B65H 2404/725* (2013.01); *B65H 2511/20* (2013.01); *B65H 2511/30* (2013.01); *B65H 2511/51* (2013.01); *B65H 2511/515* (2013.01); *B65H 2555/13* (2013.01); *B65H 2801/06* (2013.01)

(58) Field of Classification Search

CPC ..... B65H 31/18; B65H 31/26; B65H 31/34; B65H 31/36; B65H 33/00; B65H 33/06; B65H 33/08; B65H 2301/152; B65H 2301/363; B65H 2301/4219; B65H 2301/42194; B65H 2513/51; B65H 2513/512; B65H 2513/514; B65H 2515/71; B65H 2515/704; B65H 2515/714; B65H 2555/13; B65H 2601/525; B65H 29/041; B65H 29/04; B65H 9/06; B65H 9/08

See application file for complete search history.

(56) References Cited

U.S. PATENT DOCUMENTS

| | | | | |
|---|---|---|---|---|
| 3,860,127 | A * | 1/1975 | Fassman | B65G 57/081 414/791.2 |
| 6,991,229 | B2 * | 1/2006 | Yamakawa | B65H 29/041 271/204 |
| 7,641,195 | B2 * | 1/2010 | Suzuki | B65H 29/28 271/204 |
| 7,857,307 | B2 * | 12/2010 | Tamura | B65H 29/041 271/223 |
| 7,971,875 | B2 * | 7/2011 | Iino | B62B 3/04 271/213 |
| 8,002,267 | B2 * | 8/2011 | Iemura | B65H 3/06 271/110 |
| 8,083,225 | B2 * | 12/2011 | Ohishi | B65H 29/52 271/176 |
| 8,113,508 | B2 * | 2/2012 | Onodera | B65H 29/14 271/188 |
| 9,028,189 | B2 * | 5/2015 | Sasaki | B42B 5/103 281/21.1 |

* cited by examiner

*Primary Examiner* — Ernesto Suarez
(74) *Attorney, Agent, or Firm* — Manabu Kanesaka

(57) ABSTRACT

A self-hold type solenoid pulls a plunger by passage of electric current, and attracts and holds with permanent magnets also after interruption of the passage of electric current. A stopper member shifts between a regulation position for striking a front end of a transported sheet and a retracted position retracted from the regulation position by operation of the plunger. The self-hold type solenoid enhances the pull force of the plunger by being supplied with an electric current corresponding to one pulse at timing at which the transported sheet strikes the stopper member existing in the regulation position, and the stopper member is prevented from retracting by receiving an impact in striking the sheet.

12 Claims, 9 Drawing Sheets

DRIVE APPARATUS, SHEET TRANSPORT APPARATUS AND SHEET COLLECTION APPARATUS

RELATED APPLICATIONS

The present application is based on, and claims priority from, Japanese Application No. 2014-092614 filed Apr. 28, 2014, the disclosure of which is hereby incorporated by reference herein in its entirety.

TECHNICAL FIELD

Background of the Invention

1. Field of the Invention

The present invention relates to a drive apparatus that drives a self-hold type solenoid to halt a regulation member in a single or plurality of predetermined positions, and a sheet transport apparatus and sheet collection apparatus provided with a drive device that drives a self-hold type solenoid to halt a regulation member in a single or plurality of predetermined positions.

2. Description of the Related Art

Conventionally, a self-hold type solenoid (keep solenoid) has been known in which permanent magnets are combined with a magnetic coil that pulls a plunger, the plunger is pulled by applying a voltage to the magnetic coil (hereinafter, simply referred to as "coil") for only a short time, and after pulling, it is possible to hold the plunger in the pulled position with the permanent magnets. By using the self-hold type solenoid, after pulling the plunger like the conventional solenoid, even when passage of electric current through the coil is interrupted, it is possible to hold the plunger in the pulled position, and electric power saving is thereby allowed.

On the other hand, a drive apparatus is known in which a regulation member is attached to a plunger of a solenoid, and a transport target body traveling is struck by a contact surface of the regulation member, and is thereby halted in a single or plurality of positions.

Then, by using the self-hold type solenoid in such a drive apparatus, it is possible to hold the plunger in the pulled position in a non-current passage state even when the passage of electric current through the coil is halted immediately after pulling the plunger to the pulled position, and it is thereby possible to actualize an energy-saving type drive apparatus that enables the transport target body to be halted in the position of the contact surface of the regulation member.

However, by an impact when the transport target body strikes the regulation member, it sometimes happens that the plunger cannot be held in the pulled position by the permanent magnets of the keep solenoid, and that the regulation member moves from a regulation position and is not able to regulate the regulation target product.

As a specific example of the drive apparatus, for example, an image formation system such as a copier is provided with a collection apparatus to perform post-processing on a sheet with an image formed thereon, and a stopper as a regulation member that regulates the sheet to guide onto a collection tray in a collection section when a front end of the sheet transported to the collection apparatus strikes.

The sheet collection apparatus provided with such a stopper is provided with a single or plurality of so-called offset functions for changing a collection position to load when a certain amount of sheets are collected.

As the stopper in the sheet collection apparatus, for example, the stoppers are provided respectively in two portions in a sheet transport direction, and the stopper provided on the upstream side is configured to shift between a regulation position to strike the front end of the sheet to regulate and a retracted position. In other words, when the upstream-side stopper is in the retracted position, a document strikes the downstream stopper at its front end to be aligned, and is collected in a downstream stopper position. Further, when the upstream-side stopper is in the regulation position, a document is collected in an upstream-side stopper position offset to the upstream side relative to the position of the downstream-side stopper. It is known that a keep solenoid is used as an actuator to shift the stopper, and that the stopper is held in an alignment position by making the plunger a pulled state with the permanent magnet.

However, since the keep solenoid holds the plunger by only the magnetic force of the permanent magnet with non-passage of electric current to maintain the regulation member (stopper) in the regulation member, when a force larger than the force for holding the plunger by the permanent magnet is applied, the plunger is sometimes displaced from the pulled position to change the position of the stopper.

In the above-mentioned sheet collection apparatus, when a sheet with large basis weight (kinetic energy) strikes the stopper, the plunger is displaced from the pulled position by the impact, and it is not possible to regulate the sheet in the predetermined position.

The present invention is made in view of the above-mentioned issue, and it is an object of the invention to provide a drive apparatus which increases a hold force of a keep solenoid when an external force is applied to enable a regulation member to be held stably in a predetermined position to which the member is shifted.

SUMMARY OF THE INVENTION

A drive apparatus according to the present invention is a drive apparatus which causes a transport target body traveling to strike a contact surface of a regulation member and thereby halts the transport target body in a single or plurality of predetermined regulation positions on a tray, and is provided with a self-hold type solenoid which has a magnetic coil and a permanent magnet, shifts a plunger from a first position to a second position by passage of electric current through the magnetic coil for a certain time, and which holds the plunger in the second position with the permanent magnet even when the passage of electric current through the magnetic coil is interrupted, and a control device that controls the passage of electric current through the solenoid and interruption of the passage of electric current, where the control device interrupts the passage of electric current after shifting the plunger from the first position to the second position by the passage of electric current through the solenoid, and after interrupting the passage of electric current, maintains the plunger in the second position against a contact force of the transport target body with the contact surface, by passage of electric current again through the solenoid for a certain time before the transport target body strikes the regulation member. By this means, even when a strong impact is applied to the regulation member held by the attraction force of the permanent magnet of the self-hold type solenoid, since the solenoid is able to reliably hold the regulation member in the predetermined position, it is not necessary to use a large solenoid, and it is possible to suppress increases in the cost and power consumption.

DESCRIPTION OF THE PREFERRED EMBODIMENTS

Embodiments in the case of applying a drive apparatus (device) according to the present invention to a sheet collection apparatus will be described below with reference to drawings.

Figure 1:
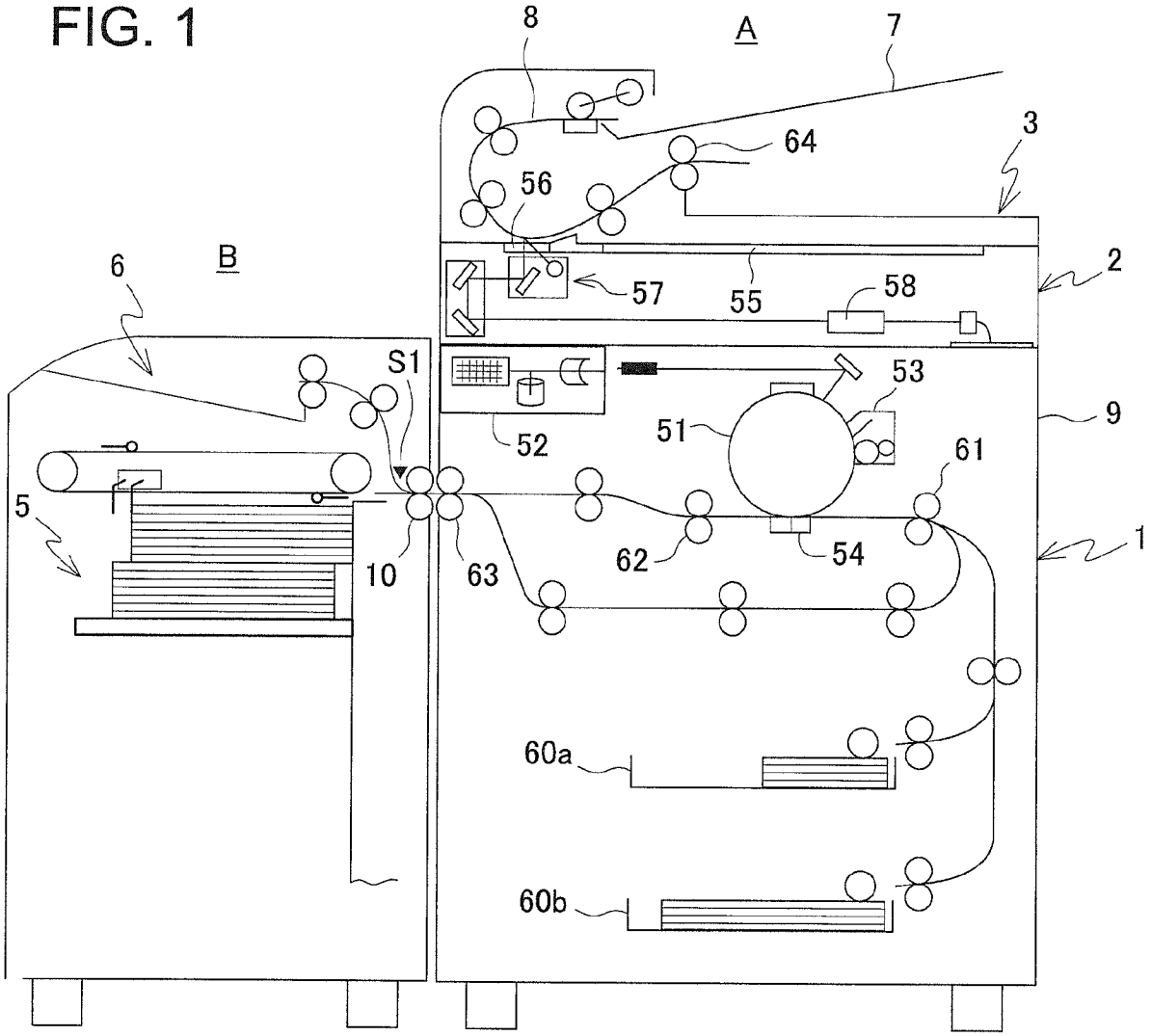
FIG. 1 schematically illustrates an entire configuration of an image formation system.

FIG. 1 schematically illustrates an entire configuration of an image formation system provided with a sheet collection apparatus. As shown in the figure, the image formation system is comprised of an image formation apparatus A and sheet collection apparatus B, and the sheet collection apparatus B is coupled to a sheet discharge outlet of the image formation apparatus A and is configured to collect sheets discharged from the image formation apparatus A.

The image formation apparatus A will be described. The image formation apparatus is broadly divided into a printing apparatus 1, document read apparatus 2, and document feed apparatus 3.

The printing apparatus 1 is provided with paper feed cassettes 60*a* and 60*b* to be attachable and detachable inside an apparatus housing 9, takes out a sheet from selected one of the paper feed cassettes 60*a*, 60*b*, prints, on the taken sheet, image data transmitted from the document read apparatus 2, and discharges the sheet to the sheet collection apparatus B with a sheet discharge roller pair 63. The image formation apparatus 1 in this example is to perform electrostatic printing, is provided with a beam projector 52 that forms an electrostatic latent image on a photosensitive drum 51, a developing device 53 that adds toner ink to the electrostatic latent image, and a transfer charger 54, and is configured to transfer image ink formed on the photosensitive drum 51 to the sheet, which is taken out of either of the paper feed cassettes 60*a*, 60*b* and is transported with a register roller 61, using the transfer charger 54, heat and fuse the image on the sheet with a fusing roller 62 disposed on the downstream side, and feed the sheet to the sheet collection apparatus B.

As the document read apparatus 2, a first platen 55 and second platen 56 each formed of a transparent material such as glass are provided parallel in the horizontal direction on a top portion of the apparatus housing 9. The first platen 55 is used in reading a manually set document, and therefore, is formed in a maximum dimension size of readable documents. Then, the second platen 56 is used in reading a document traveling at a predetermined velocity, and therefore, is formed in a maximum width size of readable documents allowed to travel.

Inside the apparatus housing 9 is disposed a read carriage 57 that is driven by a carriage motor, not shown, and that reciprocates below the first platen 55 in a sub-scanning direction (horizontal direction) while being guided by a guide shaft. The read carriage 57 reads the document set on the first platen 55 in reciprocating. Then, image data of the document read by the read carriage 57 is subjected to digital processing, is then transmitted to a data processing section 58, and is transmitted to the beam projector 52 with an image signal.

The document feed apparatus 3 passes the document set on a paper feed tray 7 through the second platen 56 with a document feed mechanism 8 to discharge from a discharge roller pair 64. Accordingly, when a document is set on the paper feed tray 7, the read carriage 57 waits in a position of the second platen 56, and reads the document passing.

The sheet collection apparatus B collects sheets which are printed in the image formation apparatus A and discharged. Then, the sheet collection apparatus B is comprised of a first collection section 5 (collection device) for collecting a large amount of sheets e.g. maximum 3,000 sheets, and a second collection section 6 for collecting a small number of sheets e.g. maximum about 100 sheets and enabling the sheets to be removed directly by an operator from the outside. In such a sheet collection apparatus B, the first collection section 5 performs collection of sheets by the drive apparatus according to the present invention, and will specifically be described below.

Figure 2:
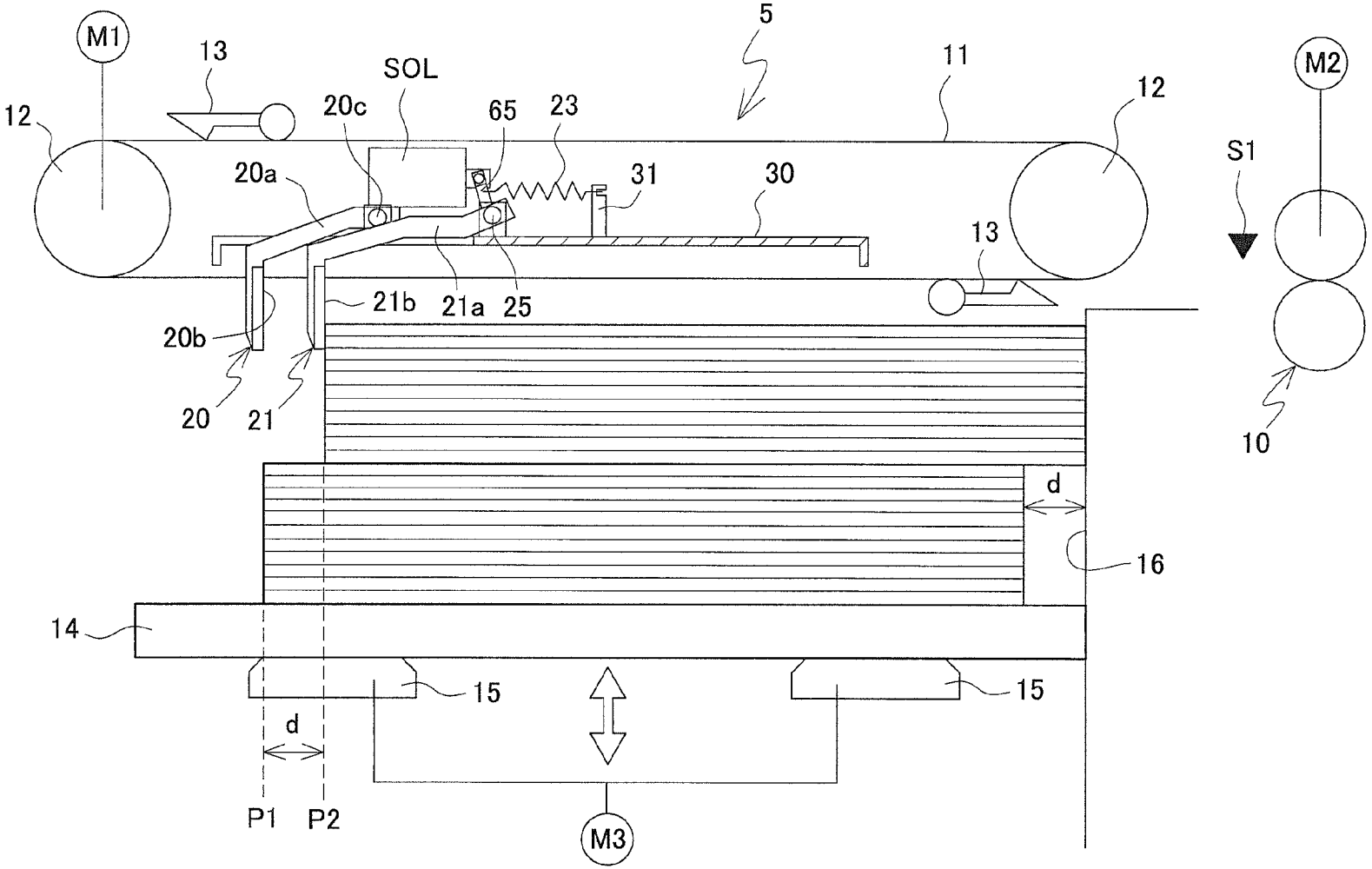
FIG. 2 shows a side elevational view illustrating a configuration of principal part of a first collection section.
Figure 3:
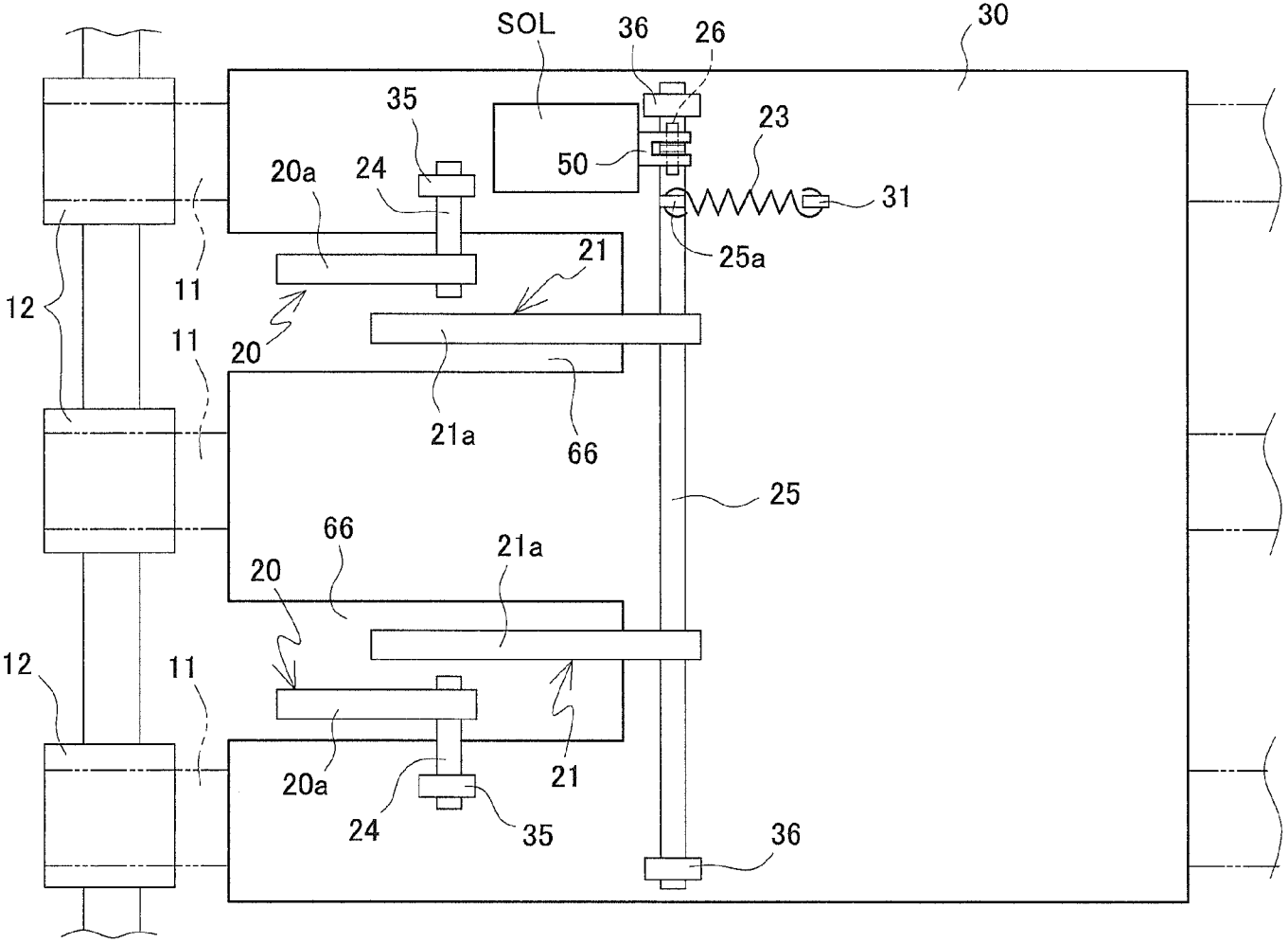
FIG. 3 shows a plan view illustrating the configuration of principal part of the first collection section.

FIG. 2 shows a side elevational view of the first collection section (hereinafter, simply referred to as "collection section") 5, and FIG. 3 shows a plan view thereof. The collection section 5 collects sheets with an up-and-down tray 14, and the up-and-down tray 14 is driven by an up-and-down plate 15, and slides and shifts up and down. The up-and-down plate 15 is fitted into a slide groove formed in a wall surface 16 of the apparatus, and moves up and down. In addition, it is configured that the plate 15 shifts upward by an attached wire being wound by forward rotation of a wind member coupled to an up-and-down motor M3, and shifts downward under its own weight by the wire being relaxed by backward rotation of the wind member.

The collection section 5 is provided with an entrance roller pair 10 that is opposed to the sheet discharge roller pair 63 of the image formation apparatus A and that is driven by a discharge motor M2, and feeds the sheet fed out of the image formation apparatus A to discharge belts 11.

As the discharge belt 11 extended between a pair of rotating bodies 12 driven by a belt motor M1, three belts are arranged parallel with the transport direction of the sheet, and each discharge belt 11 is provided with two grippers 13 in relation to shifts in mutually opposite lateral directions in its infinite trajectory. In this gripper 13, one end is fixed to the discharge belt 11, and the other end is movable. Accordingly, when the rotating bodies 12 rotate in a clockwise direction in FIG. 2 and the gripper 13 arrives at a position opposed to the entrance roller pair 10, the sheet fed out of the entrance roller pair 10 is grasped by the end portion on the free side of the gripper 13 and the outer surface of the discharge belt 11, and is pulled out toward the front end side of the collection section 5.

Between respective discharge belts 11 in a travel direction are disposed first stopper members 20 and second stopper members 21 that are regulation members to halt the sheet fed as a transport target body in a predetermined regulation position so as to introduce into the collection section 5. The first stopper member 20 and second stopper member 21 release the grasp by striking the front end of the sheet fed while being grasped by the discharge belt 11 and gripper 13, and regulate the sheet to drop and introduce onto the collection section 5. Between upper and lower travel trajectories of the discharge belt 11 is arranged a stay 30 formed of a plate where opposite ends are installed in side plates of the apparatus to enhance the strength of the apparatus, and the first stopper member 20 and second stopper member 21 are supported on the stay 30. In other words, herein, the sheet is transported to a position of the first stopper member 20 or second stopper member 21 by the sheet transport mechanism comprised of the entrance roller 10, discharge belts 11 and grippers 13, and is collected in the collection section 5.

Then, by providing the first stopper member 20 and second stopper member 21 at a distance from each other in the travel direction of the sheet transported by being grasped, sheets which strike the first stopper member 20 and are dropped and collected into the collection section 5, and sheets which comes into contact with the second stopper member 21 and are dropped and collected into the collection section 5 are capable of being collected in an offset state with a distance d between a first collection position P1 and a second collection position P2, and it is possible to perform jog storage with sheets divided for each copy.

In order to thus switch between the first stopper member 20 and the second stopper member 21 to cause the fed sheet to strike, in contrast to the fact that the first stopper member 20 is fixed, the second stopper member 21 is configured to be swingable to be able to move into or from a travel path of the sheet.

Described next are configurations of the first stopper member 20 and second stopper member 21. The first stopper member 20 is comprised of an arm portion 20*a* such that one end is supported by a fix shaft 24 and that the other end extends in a carry direction of the sheet, and a contact portion 20*b* that the front end portion of the carried sheet strikes. The fix shaft 24 is supported by a first bearing 35 installed fixedly onto the top surface of the stay 30, and therefore, the first stopper member 20 is fixed to the stay 30. Then, as shown in FIG. 3, in the stay 30 are formed cuts 66 between respective discharge belts 11, the contact portion 20*b* is disposed to protrude from the cut 66 to a transport path of the sheet, and the first stopper member 20 is thereby capable of being struck by the sheet with the contact portion 20*b* to regulate. At this point, for example, to the contact surface of the contact portion 20*b* that the sheet strikes is attached a buffer member such as a sponge and rubber. In addition, as the buffer member in this case, it is not preferable to use a high-friction material because of interfering with the dropping of the sheet into the collection section 5.

The second stopper member 21 on the swing side is comprised of an arm portion 21*a* that extends in the carry direction of the sheet as in the arm portion 20*a* of the first stopper member 20, and a contact portion 21*b* that the front end portion of the carried sheet strikes. In addition, the same buffer member as in the contact portion 20*b* is also attached to the contact surface with the sheet of the contact portion 21*b*. Then, in the case of the second stopper member 21, a shaft 25 (rotating shaft) that fixedly supports one end of the arm portion 21*a* is supported rotatably by a second bearing 36 installed fixedly onto the top surface of the stay 30. Accordingly, the stopper member 21 swings by rotation of the rotating shaft 25, and the contact portion 21*b* thereby moves into/from the transport path of the sheet.

A keep solenoid SOL as a drive device that drives the rotating shaft 25 is installed onto the top surface of the stay 30, and a plunger 50 is coupled to a protrusion piece 65 formed while protruding from the surface of the rotating shaft 25 via a coupling pin 26. A pull spring 23 is extended between an attachment piece 25*a* formed on the surface of the rotating shaft 25 and a protrusion piece 31 fixed onto the top surface of the stay 30, and biases the plunger 50 in a direction opposite to a pull direction by the keep solenoid SOL.

In such a second stopper member 21, in FIGS. 2 and 3, the plunger 50 is in a first position in a state the plunger 50 is pulled inside a case of the keep solenoid SOL, and at this point, the contact portion 21*b* moves into the transport path of the sheet against bias of the pull spring 23. Accordingly, in the sheet transported while being grasped by the discharge belt 11 and the gripper 13, the shift is halted in striking the contact surface 21*b*, and the sheet is released from the grasp by the discharge belt 11 and the gripper 13, and is introduced into the collection section 5.

Then, when the plunger 50 shifts rightward as viewed in FIG. 2 by passage of electric current through the keep solenoid SOL in the reverse direction and arrives at a second position, the rotating shaft 25 rotates in a clockwise direction, the contact portion 21*b* retracts from the transport path of the sheet, and therefore, the sheet is transported without striking the second stopper member 21*b*, and strikes the contact portion 21*a* of the first stopper member 20. By this means, transport of the sheet is halted, and the sheet is released from the grasp by the discharge belt 11 and the gripper 13 and is introduced into the collection section 5. At this point, the state in which the contact portion 21*b* is retracted from the transport path of the sheet is held by the biasing force of the pull spring 23.

Figure 4:
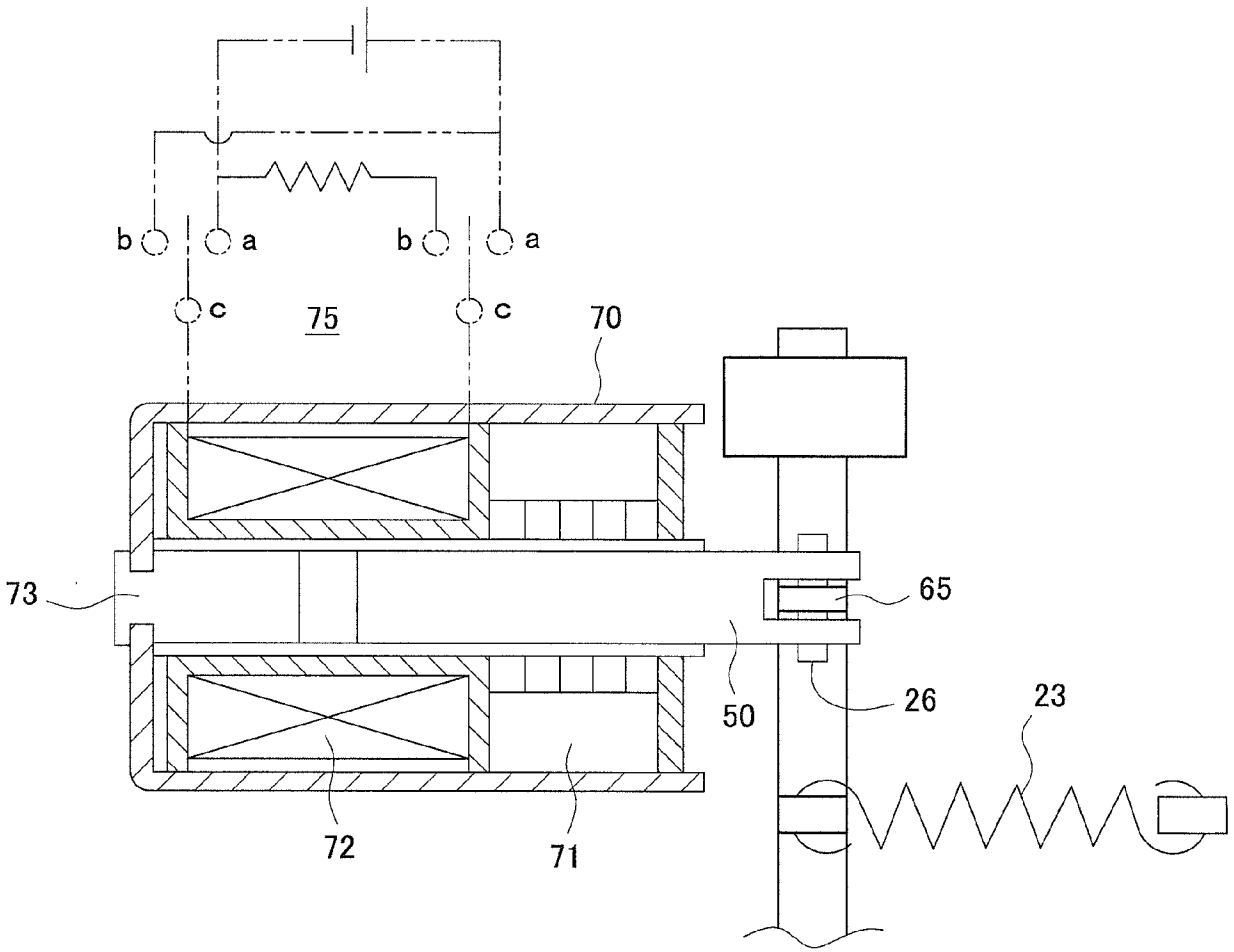
FIG. 4 shows a plan view to explain a configuration of a self-hold type solenoid (keep solenoid)

Herein, the keep solenoid SOL is a self-hold type solenoid which shifts the plunger 50 by instantaneous passage of electric current through the magnetic coil, pulls and holds with the permanent magnet after shifting, and thereby eliminates passage of electric current during this period. FIG. 4 illustrates the structure of the keep solenoid SOL with the schematic view, and the structure includes permanent magnets 71, magnetic coil 72, fix iron core 73, and plunger 50 inside a case 70, and is comprised thereof. The magnetic coil 72 is connected to a power supply 74 via a switch 75 and is supplied with an operation electric current. The switch 75 is a two-pole double-throw switch, usually does not pass an electric current through the magnetic coil 72 as shown in the figure, and by connecting c contacts to a contacts or b contacts, changes the polarity to pass an electric current through the magnetic coil 72.

Figure 5A:
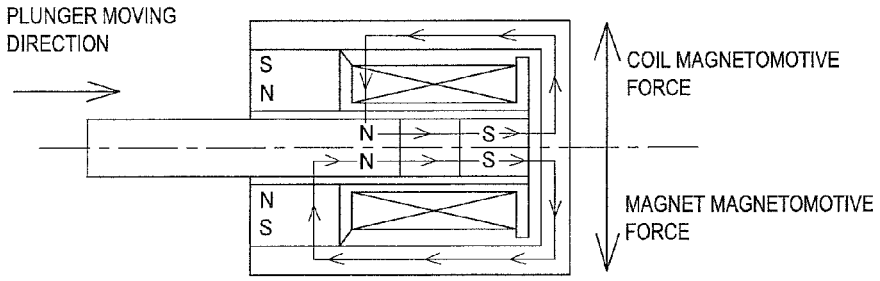
FIGS. 5A to 5D show explanatory views of operation of the self-hold type solenoid.
Figure 5B:
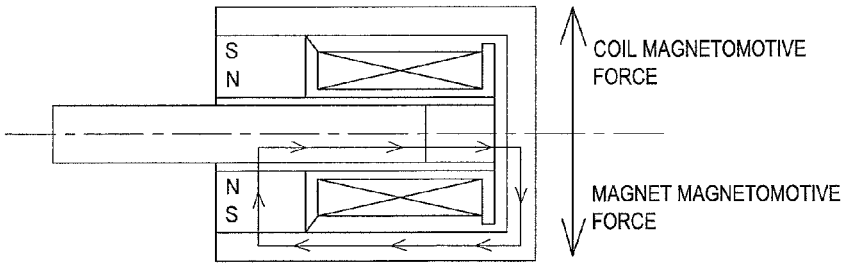

The operation of the keep solenoid will be described with reference to FIGS. 5A to 5D. FIG. 5A illustrates operation at the time of pulling the plunger 50. By connecting the c contact of the switch 75 to the a contact, an electric current is passed through the magnetic coil 72 to induce the electromagnetic force in the same direction as in the magnetomotive force of the permanent magnet 71. By this means, the plunger 50 is pulled by the magnetomotive force of the permanent magnet 71 and the magnetomotive force of the magnetic coil 72, and the second stopper member 21 is in a regulation position in which the contact portion 21*b* moves into the transport path of the sheet. Then, after pulling the plunger 50, the switch 75 is switched to a state in which the c contact thereof is not connected to any of the a contact and the b contact to interrupt the passage of electric current through the magnetic coil 72, and at this point, as shown in FIG. 5B, the state of pulling the plunger 50 is maintained by the magnetomotive force of the permanent magnet 71. Accordingly, in this state, the sheet transported while being grasped by the discharge belt 11 and the gripper 13 strikes the contact surface of the contact portion 21*b*, and is collected in the collection section 5 while being regulated by the wall surface 16.

Figure 5C:
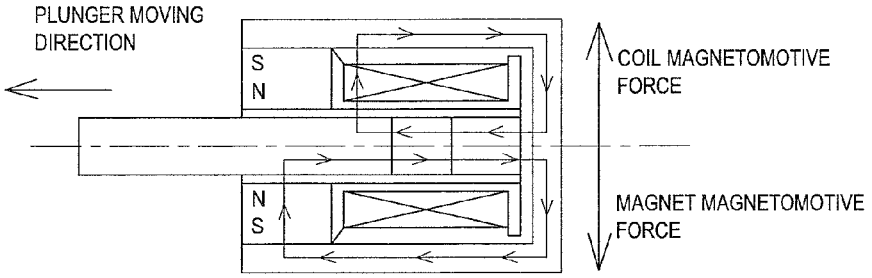

On the other hand, when the electric current is passed through the magnetic coil 72 while changing the polarity by connecting the c contact of the switch 75 to the b contact, as shown in FIG. 5C, the electromagnetic force of the magnetic coil 72 is induced in a direction for canceling the magnetomotive force of the permanent magnet 71, and the force for pulling the plunger 50 is thereby released. Therefore, the plunger 50 shifts in a protrusion direction opposite to the pull by the biasing force of the pull spring 23, and the second stopper member 21 is maintained by the biasing force of the pull spring 23 in a state in which the contact portion 21*b* is retracted from the transport path of the sheet even after interrupting the passage of electric current. Accordingly, in this state, the sheet transported while being grasped by the discharge belt 11 and the gripper 13 strikes the contact surface of the contact portion 20*b*, and is collected in the collection section 5 while being at a distance d from the wall surface 16.

For such shift control of the second stopper member 21, the position of the sheet undergoing collection at this point is checked, and when the collection position is the first position P1 on the downstream side in the sheet discharge direction, an operation electric current corresponding to one pulse is supplied to the keep solenoid SOL to shift the second stopper member 21 from the retracted position to the regulation position. By this means, the discharged sheet strikes the second regulation member 21 at its front end, and is loaded in the second position P2 on the up-and-down tray.

On the other hand, when the collection position is the second position P1 on the upstream side from the first position, a return electric current corresponding to one pulse is supplied to the keep solenoid to shift the second stopper member 21 from the regulation position to a return position. By this means, the discharged sheet strikes the first regulation member at its front end, and is loaded again in the first position P1 on the up-and-down tray.

Herein, the state in which the second stopper member 21 moves the contact portion 21*b* into the transport path of the sheet is held by the plunger 50 being pulled into the case 70 of the keep solenoid SOL against the pull force of the pull spring 23 by the permanent magnet 71 of the keep solenoid SOL. However, in the case where rigidity of the sheet is strong or the sheet has a large size and is heavy, when an impact in the sheet striking is large in the contact portion 21*b* and the pulled state of the plunger 50 cannot be held by the magnetomotive force of the permanent magnet 71 in combination with the pull force of the pull spring 23, a malfunction occurs where the contact portion 21*b* retracts from the transport path of the sheet.

Figure 5D:
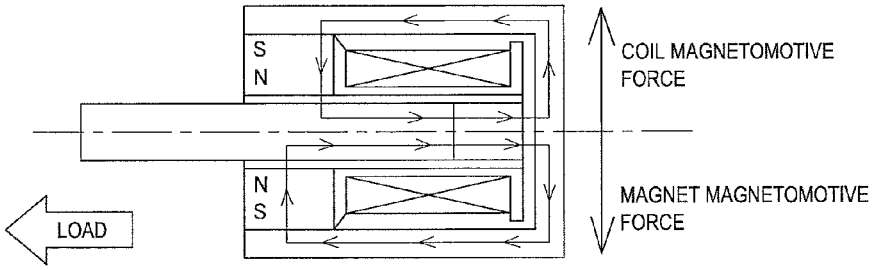

Therefore, in order to reliably hold the pulled state of the plunger 50, at timing at which a load is imposed on the plunger 50 i.e. at timing at which the sheet strikes the contact portion 21*b*, by connecting the c contact of the switch 75 to the a contact for a certain period, the operation electric current corresponding to one pulse is passed through the magnetic coil 72. In this way, as shown in FIG. 5D, when the sheet strikes and a load in the arrow direction is imposed on the plunger 50, since the electromagnetic force of the magnetic coil 72 and the magnetomotive force of the permanent magnet 71 work in the same direction, the plunger 50 does not protrude and is held in the pulled state, and it is reliably prevent the contact portion 21*b* from retracting from the transport path of the sheet due to that the sheet strikes.

Then, the sheet collection apparatus B collects sheets while offsetting in the first position P1 and second position P2 to execute until the up-and-down plate 15 descends to the bottom dead center and the collection section 5 is full of sheets. Then, when the section 5 is full of sheets, the apparatus B transmits full information to the image formation apparatus A, and instructs the apparatus A to halt discharge of a sheet.

As described above, by using the keep solenoid SOL, and performing electric current passage control of supplying an operation electric current, interrupting passage of the electric current after driving the plunger 50, and subsequently, supplying an operation electric current corresponding to one pulse at timing at which the sheet arrives at the contact portion 21*b*, it is possible to collect sheets reliably in an offset state, and to perform electric power saving of the sheet collection apparatus B.

Figure 6:
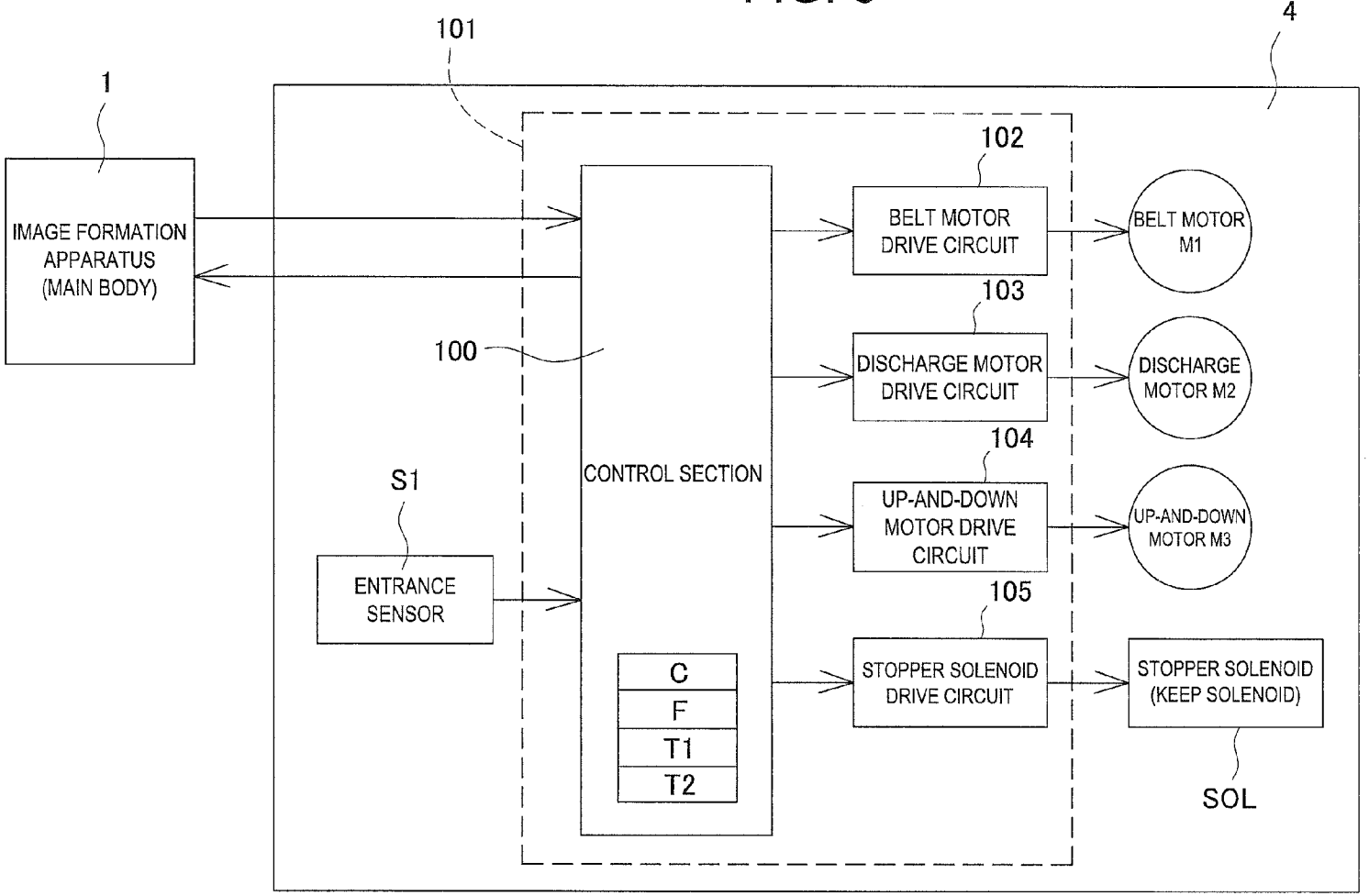
FIG. 6 shows a block diagram to explain a control configuration of a sheet collection apparatus B.

Described next is the electric current passage control for the keep solenoid SOL. An example of a control configuration for performing the electric current passage control will be described with reference to a block diagram of FIG. 6. A control section 100 is a one-chip microcomputer including a CPU, ROM, RAM and the like. In the control section 100, the CPU executes programs stored in the ROM corresponding to commands and information from the image formation apparatus A, and detection results of the sensor, and thereby controls each section of the sheet collection apparatus B to perform transport and collection of sheets. On a working area of the RAM are set a number-of-sheet counter C, flag register F, and each register of timer registers T1 and T2.

On a control board 101 constituting the control device are implemented the one-chip microcomputer as the control section 100, belt motor drive circuit 102, discharge motor drive circuit 103, up-and-down motor drive circuit 104, and stopper solenoid drive circuit 105. Herein, the belt motor drive circuit 102 drives the belt motor M1 that is a drive source of the discharge belt 11. The discharge motor drive circuit 103 drives the discharge motor M2 that is a drive source of the entrance roller pair 10. The up-and-down motor drive circuit 104 drives the up-and-down motor M3 that is a drive source for moving the up-and-down tray 14 up and down. The stopper solenoid drive circuit 105 performs switching of the switch 75 to control the passage of electric current through the keep solenoid SOL.

The entrance sensor S1 detects the front end of the sheet which is printed in the image formation apparatus A and transported, and is the so-called lever type sensor comprised of a detection lever that undergoes displacement by contact with the sheet, and a transmission sensor that detects the displacement of this detection lever to output a sheet detection signal to the control section 100. As this kind of sensor, for example, it is possible to various kinds of sensors such as a reflection type sensor that detects the front end of the sheet and a transmission sensor that directly detects the sheet without through a detection lever.

Next, for control of the sheet collection apparatus B by the control section 100, offset control and hold control of the second stopper member 21 directly related to the present invention will be described based on flowcharts.

Figure 7:
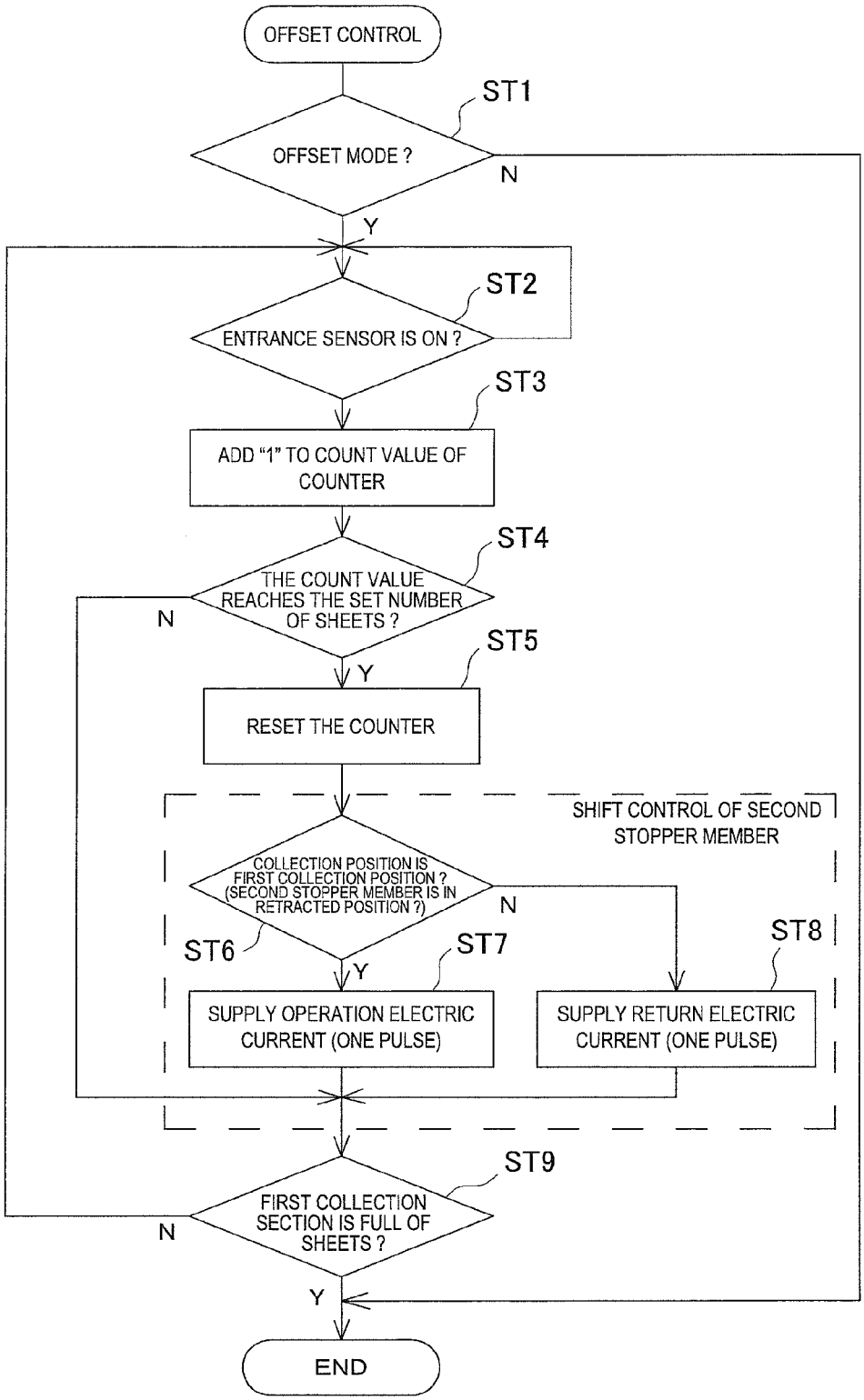
FIG. 7 shows a flowchart to explain offset control operation by a control section.

FIG. 7 shows a flowchart of offset control. As described previously, the offset is to collect sheets which are printed and sent from the image formation apparatus A in different collection positions for each predetermined amount, and the offset control is performed based on a command from the image formation apparatus A.

The control section 100 determines whether offset information (mode) is transmitted from the image formation apparatus A in step ST1, and in the case where the offset information is acquired, proceeds to processing of step ST2 to start a count of the number of discharged sheets.

In step ST2, the section 100 waits for input of a detection signal from the entrance sensor S1, and when the detection signal is input, adds "1" to a count value of the number-of-sheet counter C in processing of step ST3. Then, in processing of step ST4, the section 100 determines whether the count value of the number-of-sheet counter C reaches the predetermined number of sheets. For example, in the case of collecting sheets every 50 copies by offsetting, a user sets a numeric value of "50" in an input section, not shown, of the image formation apparatus A, this numeric value is transmitted from the image formation apparatus A also to the control section 100, and in determining that the count value reaches "50", the control section 100 performs processing of step ST5.

In the processing of step ST5, the control section 100 resets the number-of-sheet counter C, and executes shift control of the second stopper member 21. In processing of step ST6 in the shift control of the second stopper member 21, the section 100 determines whether the collection position is the first collection position P1 from a state of a flag in the flag register F. When the control section 100 supplies the operation electric current to the keep solenoid SOL, and shifts the contact portion 21*b* to the regulation position, the section 100 writes "1" in the flag register F, and thereby sets the flag. Then, when the section 100 supplies the return electric current to shift the second stopper member 21 to the retracted position, the section 100 sets content of the flag register F for "0", and thereby resets the flag.

When the flag is not set in the flag register F, the control section 100 determines that the collection position is the first collection position P1, and performs processing of step ST7. In other words, since the number of sheets to collect in the first collection position P1 reaches "50", in order to next collect sheets in the second collection position P2, the section 100 performs control of moving the contact portion 21*b* of the second stopper member 21 into the transport path of the sheet from the state of retracting from the transport path of the sheet.

Accordingly, in the processing of step ST7, the control section 100 performs control of connecting the c contact of the switch 75 to the a contact in the keep solenoid SOL for a certain period, thereby supplies the operation electric current corresponding to one pulse to the magnetic coil 72, and shifts the plunger 50 in the pull direction.

On the other hand, in the processing of step ST6, when it is determined that the flag is set in the flag register R, the section 100 performs processing of step ST8, and causes the keep solenoid SOL to perform return operation so as to change the collection position from the second collection position P2 to the first collection position P1. In this case, the control section 100 performs control of connecting the c contact of the switch 75 to the b contact in the keep solenoid SOL for a certain period, thereby supplies the return electric current corresponding to one pulse to the magnetic coil 72, and performs processing of step ST9.

Then, in the processing of step ST9 after performing the control of changing the collection position in step ST7 or step ST8, the control section 100 determines whether the collection section 5 is full, and when the section 5 is full, finishes the offset control, while when the section 5 is not full, returning to the processing of step ST2. Although not shown in the figure, a collection state of sheets in the collection section 5 is detected with a level sensor, or is detected by counting the detection signal from the entrance sensor S1. Then, when the control section 100 detects that the section 5 is full, the section 100 transmits full information to the image formation apparatus A, and instructs the apparatus A to halt discharge of a sheet.

Further, in the processing of step ST4, when a count value of the number-of-sheet counter C does not reach the predetermined number of sheets, in order to subsequently perform collection in the same collection position, the section 100 does not perform shift control of the second stopper member 21, and directly performs the processing of step ST9.

Thus, for a period during which the offset mode is indicated from the image formation apparatus A and sheets are fed continuously, whenever the predetermined number of sheets is fed, the section 100 performs alternately the control of moving the contact portion 21*b* into the transport path of the sheet (step ST7) or the control of retracting the portion 21*b* from the transport path of the sheet (step ST8), and it is thereby possible to perform collection for offsetting sheets.

Figure 8:
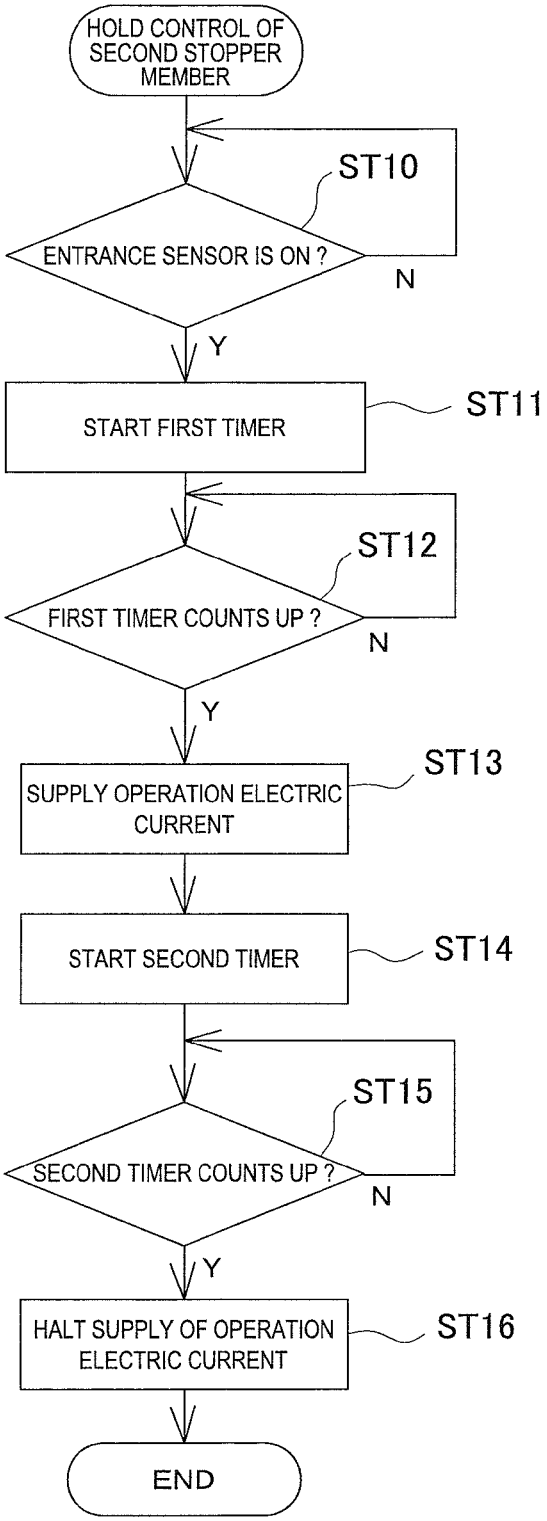
FIG. 8 shows a flowchart to explain control operation to hold a second stopper member by the control section.
Figure 9:
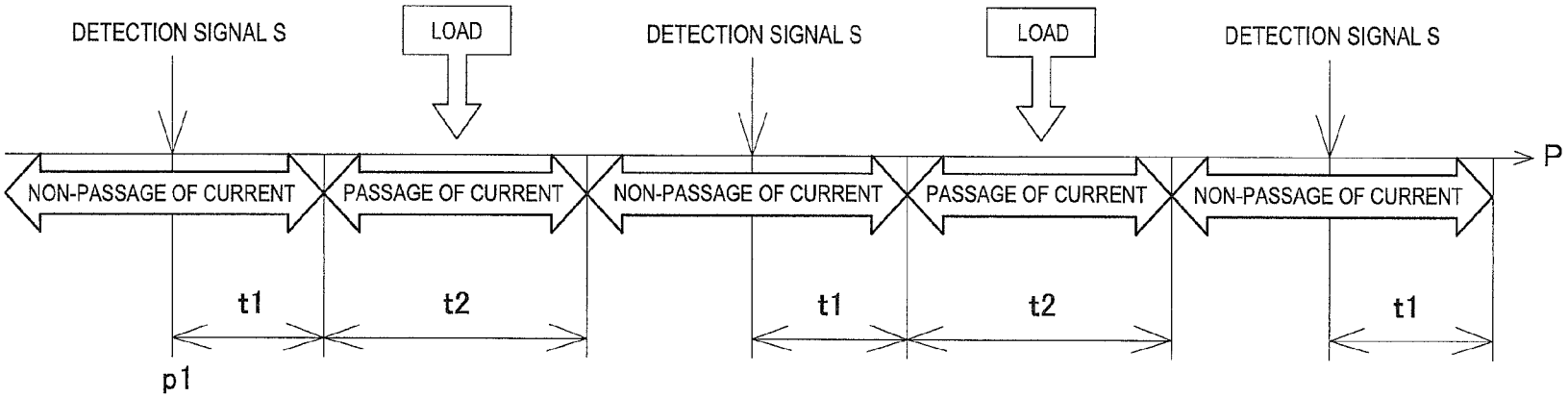
FIG. 9 shows a timing chart to explain timing operation to hold the second stopper member by the control section.

FIG. 8 shows the flowchart of the hold control of the second stopper member 21, and FIG. 9 shows a timing chart for proceeding in the direction shown by the arrow P.

When the entrance sensor S1 detects the front end of the sheet and outputs a detection signal s (FIG. 9) at the time of p1, the control section 100 starts clock count operation by the timer register T1, and starts a first timer. The first timer is beforehand set for a first timer value t1 (FIG. 9) corresponding to a time required for the sheet to shift a distance from the position of the entrance sensor S1 to a predetermined position immediately before the second stopper member 21, and when the control section 100 determines that the count value of the timer register T1 reaches the first timer value t1 in step ST12, the section 100 performs processing of step ST13 and supplies the operation electric current to the keep solenoid SOL.

Then, in step ST14, the control section 100 starts clock count operation by the timer register T2, and starts a second timer. The second timer is beforehand set for a second timer value t2 corresponding to a time required for shifting a distance obtained by adding a certain distance to a distance from the predetermined position immediately before the second stopper member 21 i.e. the position at the time the first timer value t1 has elapsed to a position in which the sheet strikes the contact portion 21*b*, and when the control section 100 determines that the count value of the timer register T2 reaches the second timer value t2 in step ST15, the section 100 performs processing of step ST16 and interrupts supply of the operation electric current to the keep solenoid SOL.

By this means, the operation electric current corresponding to one pulse (certain time) is supplied to the keep solenoid SOL, the plunger 50 is acted upon by the pull force due to the actuation electric current in addition to the attraction force of the permanent magnet 71, and the force for holding the second stopper member 21 is reinforced. In other words, by passing the operation electric current through the keep solenoid SOL immediately before the front end of the sheet strikes the contact portion 21*b*, it is possible to prevent the pulled state of the plunger 50 due to the keep solenoid SOL from being released by a load due to an impact when the sheet strikes the contact portion 21*b*.

In this case, since residual magnetism exists in the magnetic coil 72 even when the passage of electric current through the keep solenoid SOL is interrupted, the period t2 for supplying the operation electric current of one pulse to supply may be an extremely short time e.g. about 100 ms. However, in consideration of a delay occurring in timing for generating the electromagnetic force after the passage of electric current when the timing for supplying the operation electric current is the same timing at which the sheet strikes the contact portion 21*b*, it is necessary to set the timer value t1 so as to supply immediately before the sheet strikes the contact portion 21*b*. Further, instead of depending on the timer, a sheet detection sensor may be provided in the predetermined position immediately before the second stopper member 21 so as to start supply of the operation electric current with a detection signal of the sensor. Further, a sheet detection sensor may be provided in the same position as that of the second stopper member 21 so as to interrupt the actuation electric current by detecting that the front end of the sheet arrives at the position of the second stopper member 21 i.e. the front end of the sheet strikes the second stopper member 21.

Thus, since the operation electric current is supplied to the keep solenoid SOL at the instant at which the sheet strikes the contact portion 21*b*, even sheets discharged at a high velocity or sheets with large basis weight (sheets of a large size or thick sheets) are collected in the collection section 5 in a state in which the sheets are reliably regulated by the contact portion 21*b* and the wall surface 16. Then, as shown in FIG. 9, since the operation electric current is supplied corresponding to a pulse of the second timer value t2, it is possible to suppress consumption current as much as possible. Accordingly, by using the keep solenoid SOL, it is not necessary to continue the passage of electric current to keep the plunger 50 in the pulled state, and further, since the operation electric current corresponding to one pulse is supplied only when the external force is applied to the plunger 50, it is possible to significantly reduce consumption current as compared with the case of using a normal solenoid.

Further, the control of supplying the operation electric current through the keep solenoid SOL for a certain time and thereby reinforcing the force for holding the second stopper member 21 may be performed only when the image formation system feeds sheets at a high velocity or handles sheets with large basis weight. In this case, when an operator inputs, in the input section of the image formation apparatus A, a high-velocity discharge mode or sheets with large basis weight by indication of the sheet size or the like, the control of reinforcing the force for holding the second stopper member 21 is performed.

The drive apparatus according to the present invention is applicable to regulating a sheet as appropriate, as well as being applied to the portion that functions as the sheet transport apparatus including the sheet transport mechanism comprised of the exist roll 10, discharge belts 11 and grippers 13, the first stopper member 20 and second stopper member 21 in the sheet collection apparatus B of the above-mentioned Embodiment. Described herein is the case of applying to the document feed apparatus 3.

In a paper feed opening of the document feed apparatus 3 is provided a stopper for regulating a front end of a sheet document placed on the paper feed tray 7. When the sheet document is placed on the paper feed tray 7, this stopper shifts to a regulation position to block the paper feed opening to be struck by the sheet document, and thereby prevents the sheet document from entering, while positioning the sheet document in a predetermined position on the paper feed tray 7. Then, the stopper is configured to retract from the regulation position so as to enable the sheet document to pass through, in feeding the sheet document to the transport path inside the document transport mechanism 8.

By using a keep solenoid as a drive source of such a stopper, when a sensor provided on the upstream side of the stopper detects the front end of the sheet document placed on the paper feed tray 7, an electric current is passed through the keep solenoid to pull a plunger and shift the stopper to the regulation position, and subsequently after the front end of the sheet document strikes the stopper and is aligned and positioned, the passage of electric current through the keep solenoid is interrupted. It is thereby possible to suppress power consumption. In addition, the sensor provided on the upstream side of the stopper is the sensor used as an empty sensor to detect whether or not a sheet document exists on the paper feed tray 7.

According to the above-mentioned Embodiment, using the self-hold type solenoid SOL having the plunger 50 to shift the second stopper member 21 to the regulation position and permanent magnets 73 to attract and hold the plunger 50 in the pulled position, it is configured to be able to execute first electric current passage control (shift control of the second stopper member 21) of passing an electric current through the self-hold type solenoid SOL for a certain time to pull the plunger, and after attracting to the permanent magnet, interrupting the passage of electric current, and second electric current passage control (hold control of the second stopper member 21) of passing an electric current through the self-hold type solenoid at the time of arriving at a position upstream of the position in which the front end of the sheet document comes into contact with the second stopper member, and after the front end of the document sheet contacts, interrupting the passage of electric current. Therefore, when the sheet document strikes the second stopper member 21, the pull force of the plunger is added to the attraction force of the permanent magnet, and even in the case where a strong impact is applied to the second stopper 21 held by stronger hold forces, it is possible to reliably hold the second stopper 21 in the predetermined position.

The invention claimed is:

1. A drive apparatus for transporting a transport target body, comprising:

a self-hold type solenoid which has a magnetic coil, a permanent magnet, and a plunger shifting from a first position to a second position by a passage of electric current through the magnetic coil for a predetermined time, and being held in the second position with the permanent magnet even when the passage of electric current through the magnetic coil is interrupted, the self-hold type solenoid controlling transportation of the transport target body through a shift of the plunger; and a control section that controls the passage of electric current through the self-hold type solenoid and interruption of the passage of electric current, wherein the control section includes an electric current passage shift control to pass the electric current through the magnetic coil to shift the plunger from the first position to the second position, and to interrupt the passage of the electric current after the permanent magnet attracts and holds the plunger and an electric current passage hold control to begin passing electric current to the magnetic coil while the permanent magnet is holding the plunger in the second position to increase a hold force of the plunger in the second position.

2. A sheet transport apparatus to transport a sheet, comprising:

a transport mechanism that transports the sheet;

a stopper member that is struck by a front end of the sheet transported by the transport mechanism to regulate the front end of the sheet in a predetermined position;

a self-hold type solenoid to shift the stopper member to a regulation position for regulating the front end of the sheet; and a control section that controls a passage and an interruption of electric current through the self-hold type solenoid, wherein the control section includes an electric current passage shift control to pass an electric current through self-hold type solenoid to shift the stopper member to the regulation position to regulate the front end of the sheet, and to interrupt the passage of the electric current after shifting the stopper member, and an electric current passage hold control to begin passing electric current through the self-hold type solenoid while the stopper member is in the regulation position, before the front end of the sheet strikes the stopper member at the regulation position, and to interrupt the passage of the electric current after the front end of the sheet strikes the stopper member.

3. The sheet transport apparatus according to claim 2, wherein a detection sensor that detects the front end of the sheet is provided upstream of the stopper member in a sheet transport direction, and based on a detection result of the detection sensor, the control section recognizes that the front end of the sheet arrived at a predetermined position on the upstream side of the stopper member, and starts the passage of the electric current through the self-hold type solenoid.

4. The sheet transport apparatus according to claim 3, wherein based on the detection result of the detection sensor, the control section recognizes that the front end of the sheet struck the stopper member, and interrupts the passage of the electric current through the self-hold type solenoid.

5. The sheet transport apparatus according to claim 4, wherein the control section interrupts the passage of the electric current after a lapse of a predetermined time from a time of starting the passage of the electric current through the self-hold type solenoid.

6. The sheet transport apparatus according to claim 2, wherein the self-hold type solenoid includes:

a plunger to move the stopper member to the regulation position for regulating the front end of the sheet, a magnetic coil to shift the plunger through the passage of the electric current, and a permanent magnet to attract and hold the plunger shifted by the magnetic coil, wherein the electric current passage shift control of the control section passes the electric current through the magnetic coil to shift the plunger from a first position to a second position corresponding to the regulation position, and interrupts the passage of the electric current to the magnetic coil after the permanent magnet attracts and holds the plunger, and the electric current passage hold control of the control section passes the electric current through the magnetic coil before the sheet strikes the stopper member while the permanent magnet holds the plunger at the second position, and interrupts the passage of the electric current to the magnetic coil after the sheet strikes the stopper member.

7. The sheet transport apparatus according to claim 6, further comprising an urging portion connected to the stopper member to urge the plunger, wherein when the control section controls to shift the stopper member from the regulation position to a retracted position, the electric current is passed through the magnetic coil to cancel a hold force of the permanent magnet and the urging member urges the plunger so that the plunger is released from the permanent magnet and shifts from the second position to the first position.

8. The sheet transport apparatus according to claim 7, wherein the magnetic coil is arranged adjacent to the permanent magnet in a shifting direction of the plunger, for canceling a magnetomotive force of the permanent magnet, when the control section controls to shift the stopper member from the regulation position to the retracted position, the electric current is passed through the magnetic coil to induce an electromagnetomotive force in a direction for canceling the magnetomotive force of the permanent magnet and the urging member urges the plunger so that the plunger is released from the permanent magnet and shifts from the second position to the first position, and when the control section controls to shift the stopper member from the retracted position to the regulation position, the electric current is passed through the magnetic coil to induce the electromagnetomotive force in a direction same as the magnetomotive force of the permanent magnet so that the magnetic coil and the permanent magnet attract the plunger to shift the plunger from the first position to the second position.

9. A sheet collection apparatus to collect a sheet, comprising;

a collection tray to collect the sheet;

a transport mechanism that discharges the sheet onto the collection tray;

a stopper member that is struck by a front end of the sheet discharged by the transport mechanism above the collection tray to load the sheet in a predetermined position on the collection tray;

a self-hold type solenoid that shifts the stopper member to a regulation position for regulating the front end of the sheet; and a control section that controls a passage and an interruption of electric current of the self-hold type solenoid, wherein the control section includes an electric current passage shift control to pass the electric current through self-hold type solenoid to shift the stopper member to the regulation position to regulate the front end of the sheet, and to interrupt the passage of the electric current after shifting the stopper member, and an electric current passage hold control to begin passing electric current through the self-hold type solenoid while the stopper member is in the regulation position, before the front end of the sheet strikes the stopper member at the regulation position, and to interrupt the passage of the electric current after the front end of the sheet strikes the stopper member.

10. The sheet collection apparatus according to claim 9, wherein a detection sensor that detects the front end of the sheet transported by the transport mechanism is provided upstream of the stopper member in a sheet transport direction, and based on a detection result that the detection sensor detects the front end of the sheet, the control section controls timing of start and interruption of the passage of the electric current through the self-hold type solenoid.

11. The sheet collection apparatus according to claim 10, wherein the transport mechanism is provided with an entrance roller that transports the sheet, and a gripper that is provided downstream of the entrance roller and that grasps the sheet transported by the entrance roller to transport toward the stopper member.

12. The sheet collection apparatus according to claim 9, wherein the self-hold type solenoid includes:

a plunger to move the stopper member to the regulation position for regulating the front end of the sheet, a magnetic coil to shift the plunger through the passage of the electric current, and a permanent magnet to attract and hold the plunger shifted by the magnetic coil, wherein the electric current passage shift control of the control section passes the electric current through the magnetic coil to shift the plunger from a first position to a second position corresponding to the regulation position, and interrupts the passage of the electric current to the magnetic coil after the permanent magnet attracts and holds the plunger, and the electric current passage hold control of the control section passes the electric current through the magnetic coil before the sheet strikes the stopper member while the permanent magnet holds the plunger at the second position, and interrupts the passage of the electric current to the magnetic coil after the sheet strikes the stopper member.

* * * * *